US008025210B2

(12) United States Patent
Johnson et al.

(10) Patent No.: US 8,025,210 B2
(45) Date of Patent: Sep. 27, 2011

(54) INSULATED BEVERAGE CONTAINER

(76) Inventors: Matthew J. Johnson, Meridian, ID (US); Andrew Johnson, Rupert, ID (US)

( * ) Notice: Subject to any disclaimer, the term of this patent is extended or adjusted under 35 U.S.C. 154(b) by 67 days.

(21) Appl. No.: 12/458,778

(22) Filed: Jul. 22, 2009

(65) Prior Publication Data

US 2010/0072268 A1 Mar. 25, 2010

Related U.S. Application Data

(60) Provisional application No. 61/136,648, filed on Sep. 23, 2008.

(51) Int. Cl.
*B65D 3/22* (2006.01)

(52) U.S. Cl. ..... 229/403; 229/4.5

(58) Field of Classification Search ..... 229/4.5, 229/400, 403; 220/62.12, 592.17, 592.24, 220/737, 738, 739
See application file for complete search history.

(56) References Cited

U.S. PATENT DOCUMENTS

| | | | | | |
|---|---|---|---|---|---|
| 2,266,828 | A | * | 12/1941 | Sykes | 229/403 |
| 3,203,611 | A | | 8/1965 | Anderson et al. | |
| 3,443,715 | A | * | 5/1969 | Edwards | 220/671 |
| 3,456,860 | A | * | 7/1969 | Janninck | 229/400 |
| 3,908,523 | A | | 9/1975 | Shikaya | |
| 4,211,339 | A | | 7/1980 | Itoh | |
| 5,205,473 | A | | 4/1993 | Coffin, Sr. | |
| 5,226,585 | A | | 7/1993 | Varano | |
| 5,363,982 | A | * | 11/1994 | Sadlier | 229/103.11 |
| 5,385,260 | A | * | 1/1995 | Gatcomb | 229/400 |
| 5,542,599 | A | * | 8/1996 | Sobol | 229/403 |
| 5,547,124 | A | | 8/1996 | Meuller | |
| 5,628,453 | A | * | 5/1997 | MacLaughlin | 229/403 |
| 5,669,553 | A | * | 9/1997 | Smith | 229/403 |
| 5,685,480 | A | | 11/1997 | Choi | |
| 5,713,512 | A | | 2/1998 | Barrett | |
| 5,769,311 | A | | 6/1998 | Morita et al. | |
| 6,116,503 | A | * | 9/2000 | Varano | 229/403 |
| 6,253,995 | B1 | | 7/2001 | Blok et al. | |
| 6,364,201 | B1 | | 4/2002 | Varano | |
| 6,378,766 | B2 | | 4/2002 | Sadlier | |
| 6,422,456 | B1 | * | 7/2002 | Sadlier | 229/403 |
| 6,926,197 | B2 | | 8/2005 | Hed et al. | |
| 7,281,650 | B1 | | 10/2007 | Milan | |
| 2006/0144915 | A1 | | 7/2006 | Sadlier | |
| 2007/0114271 | A1 | * | 5/2007 | Van Handel | 229/403 |
| 2007/0228134 | A1 | * | 10/2007 | Cook et al. | 229/403 |
| 2007/0284426 | A1 | * | 12/2007 | Lo | 229/403 |
| 2009/0020597 | A1 | * | 1/2009 | D'Amato | 229/403 |

FOREIGN PATENT DOCUMENTS

| | | | | |
|---|---|---|---|---|
| JP | 8230862 | A | | 9/1996 |
| JP | 11-222225 | A | * | 8/1999 |
| JP | 2004-90929 | A | * | 3/2004 |

* cited by examiner

*Primary Examiner* — Gary Elkins
(74) *Attorney, Agent, or Firm* — Richard C. Litman

(57) ABSTRACT

The insulated beverage container is a container, such as a coffee cup, providing thermal insulation for the user's hand. The container includes a vertically extending annular wall and a base, forming a beverage-receiving cup. A plurality of tubes are secured to an outer surface of the annular wall. Each tube is hollow and defines an air passage therein, and is further elongated along the vertical direction, having upper and lower air flow apertures formed therethrough. In use, heat generated by the beverage heats the air contained within the tubes. As the air rises within the tubes, ambient air at a lower temperature is drawn through the lower air flow apertures and the heated air is expelled through the upper air flow apertures, maintaining a flow of cooled air from the environment through the tubes.

9 Claims, 8 Drawing Sheets

INSULATED BEVERAGE CONTAINER

CROSS-REFERENCE TO RELATED APPLICATION

This application claims the benefit of U.S. Provisional Patent Application Ser. No. 61/136,648, filed Sep. 23, 2008.

BACKGROUND OF THE INVENTION

1. Field of the Invention

The present invention relates to cups, and particularly to an insulated beverage container, such as a coffee cup, tea cup, or the like.

2. Description of the Related Art

Beverage containers, such as cups for coffee, tea, hot chocolate, soup and the like, are typically formed from expanded polystyrene (EPS) or similar materials. EPS is an efficient thermal insulator for maintaining the beverage at a desired temperature for an extended period of time. Such cups further provide a thermal barrier between the hot or cold temperature of the beverage and the user's hand. However, EPS cups are generally considered to be environmentally unfriendly due to the fact that EPS is not biodegradable. As a result, their use has been banned in some municipalities.

Additionally, in order to print EPS cups, a slow and relatively costly off-line printing process must be used because the cups must be printed after they have been formed, and their relatively rough surface does not permit high-resolution printing. Conventional single-wall paper containers are generally considered to be more environmentally friendly than EPS cups, but they often have poor thermal insulating properties. Thus, when using paper cups, it is common to "double cup", which is the practice of serving a hot beverage in two stacked single-wall paper cups in order to provide some level of insulation. This process, however, is both expensive and wasteful.

As an alternative, cup sleeves may be utilized. Cup sleeves are wrapped around a single-wall paper cup in order to provide thermal insulation for keeping beverages hot and the hands of the user comfortable. Cup sleeves, however, are typically assembled and placed onto the cup when the beverage is served. This process requires additional labor and slows the speed of service. Further, the need for cups and sleeves requires additional and simultaneous purchasing, additional storage space, and additional inventory management. Cup sleeves further have a tendency to fall off of the cups, do not conveniently fit in all vehicle cup holders, and further cover the graphics printed on the cup.

As a further alternative, multilayered paper cups are sometimes used. Such cups typically include at least three layers, which include some form of an inner cup made from paper and an outer cover or wrapper to provide insulation. The wrapper typically forms a multiple ply sheet having at least one base sheet and at least one corrugated or embossed sheet adhered to the base sheet. Although thermally insulated and strong, such cups are expensive to manufacture because the corrugated or embossed sheet must be adhered to the base sheet in order to cover the entire surface of the base sheet through a lamination process. This is a process in which adhesive, such as hot melt or heated polyethylene, or a paste adhesive, such as a starch-based cold glue, is applied either to the surface of the embossed sheet or the base sheet, and the two sheets are pressed together to form a multiple ply insulating sheet. The wrapper is then cut out of this multiple ply sheet and wrapped around and adhered to an inner cup. The process of laminating the sheets together is both expensive and wasteful.

Further, there is a significant amount of value-added multiple ply sheet trim scrap, which is wasted when blanking the wrapper. There is also a significant amount of adhesive required to secure the embossed sheet across the entire surface of the base sheet, which is typically done along all of the tips of the corrugations or embossments. The printing process is further expensive because either the base sheet must be printed prior to laminating, which causes significant registration and distortion issues after the sheets are laminated together, or the sheet is printed after the multiple plies are laminated. This printing process is difficult because of the thickness and stiffness of the multiple ply sheet and the excess compressibility of the sheet. Additionally, it is difficult to wrap or bend the multiple ply laminated wrapper around an inner cup because of the limited flexibility of thick laminated paperboard.

It would be desirable to provide a thermally insulated beverage container that is easily disposable, formed from biodegradable materials, and that is easy to manufacture, without either excess labor or expense involved. Thus, an insulated beverage container solving the aforementioned problems is desired.

SUMMARY OF THE INVENTION

The insulated beverage container is a container, such as a coffee cup, providing thermal insulation for the user's hand. The insulated beverage container includes an annular wall having an upper end and a lower end, with the annular wall being elongated along a vertical direction. A base is secured to the lower end of the annular wall so that an upper surface of the base and the annular wall define an open interior region therein adapted for receiving and containing fluids. The annular wall and base may be formed in a conventional manner to form a beverage cup.

Further, a plurality of tubes are formed on an outer surface of the annular wall. Each tube is hollow and defines an air passage therein, with the air contained therein acting as a heat exchanger. Each tube is elongated along the vertical direction and has upper and lower air flow apertures formed therethrough. The air flow apertures may have any desired size, contour or configuration, dependent upon the desired air flow characteristics and the desired heat transfer rate. Essentially, the larger the area of each aperture, the greater the volume of air that can pass through the tube (and, conversely, the smaller the area, the more restricted heat transfer will be to insulate hot beverages within the cup). In use, heat generated by the beverage contained within the container heats the air contained within the tubes. As the air rises within the tubes, ambient air at a lower temperature is drawn through the lower air flow apertures and the heated air is expelled through the upper air flow apertures. It should be noted that the air held within the tubes is not for purposes of thermal insulation, rather the air flows from the lower, open portion of the tube to the upper portion of the tube as the air is heated, thus maintaining a constant flow of cool air from the environment through the tubes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
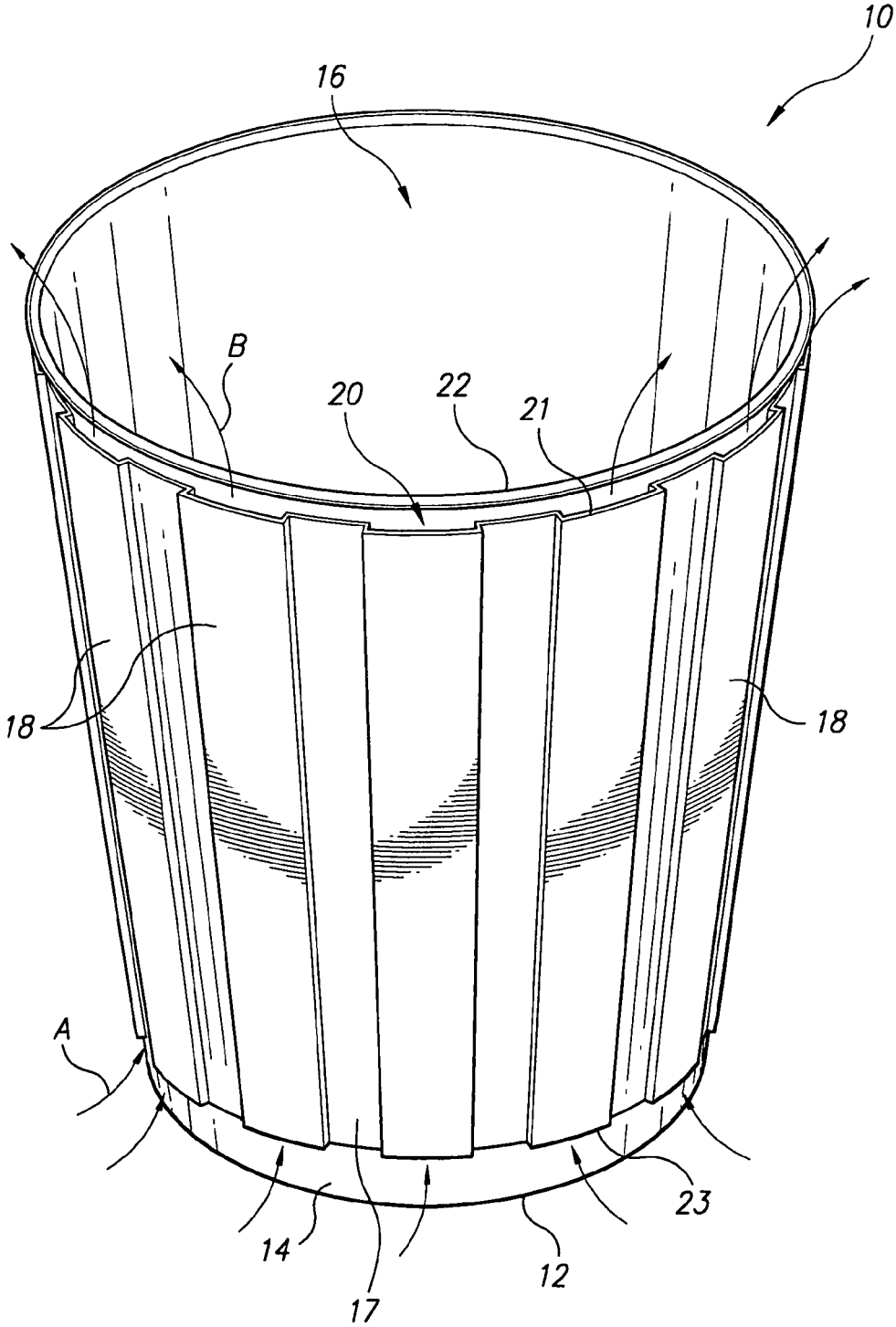
FIG. 1 is a perspective view of an insulated beverage container according to the present invention.

FIG. 1 shows a first embodiment of an insulated beverage container 10, such as a coffee cup, that provides thermal insulation for the user's hand. As shown in FIG. 1, the insulated beverage container 10 includes an annular wall 14 having an upper end and a lower end, with the annular wall 14 being elongated along a vertical direction. The upper end may have an annular lip or rim 22 formed thereon that allows for releasable attachment of a lid, as is conventionally known.

A base 12 is secured to the lower end of the annular wall 14 so that an upper surface of the base 12 and the annular wall 14 define an open interior region 16 therein adapted for receiving and containing fluids. The annular wall 14 and base 12 may be formed in any conventional manner to form a beverage receiving cup, as is conventionally known. It should be understood that the container 10 illustrated in FIG. 1 is shown for exemplary purposes only, and that the outer layer, to be described in greater detail below, may be applied to any desired beverage container. Preferably, the beverage container 10 is formed from disposable materials, such as cardboard, paper, or a polymeric material, although it should be understood that any suitable material may be used. The beverage container 10 is preferably formed integrally from a polymer-coated paper using any suitable techniques for cutting, sealing and crimping.

Figure 3:
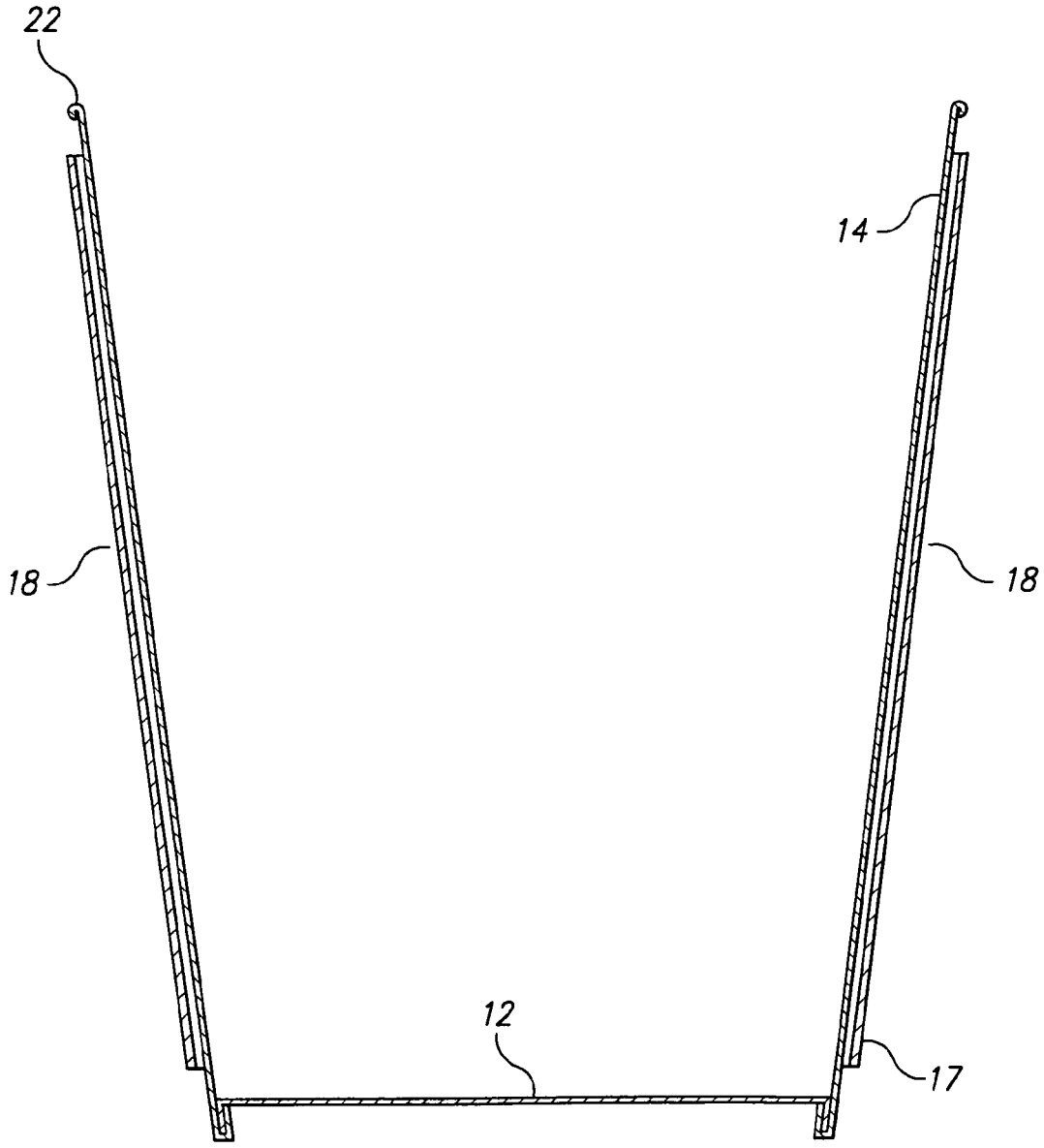
FIG. 3 is a side view in section of an insulated beverage container according to the present invention.
Figure 4:
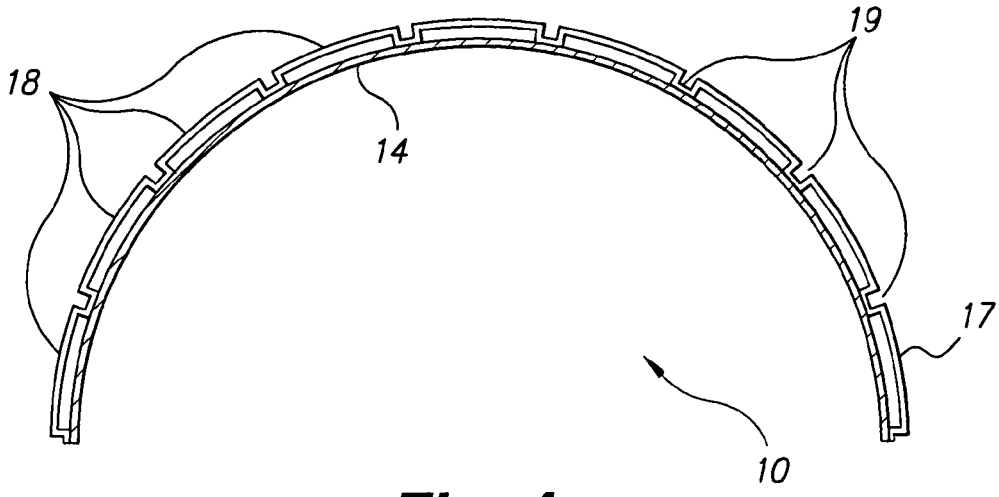
FIG. 4 is a partial top view in section of an insulated beverage container according to the present invention.

As best shown in FIGS. 1 and 3, the annular wall 14 forms an inner wall of container 10, with an outer wall 17 being fixed thereto through the use of adhesive, such as glue, or through the use of any other suitable fastening method. The outer wall 17 forms a plurality of tubes 18 having a plurality of gaps or slots 19 formed therebetween, as shown in FIG. 4. As shown in FIG. 1, each tube 18 is hollow and defines an air passage 20 therein. The air contained within air passage 20 is vented to the atmosphere, so that when a hot beverage is placed within the container 10, the air in the air passage is heated by heat transfer through the inner annular wall 14. At the same time, hot air rises, so that the heated air exits through the upper end of the air passage 20, while cooler air enters from the bottom of the air passage 20, thereby cooling the tubes 18 that form the outer wall of the container 10. Since the equilibrium process and air flow take some time, the air in air passage 20 provides some insulating effect to retard cooling of the beverage relative to an uninsulated cup, but leaves the outside of the container 10 cooler to the touch than comparable insulated cups.

Figure 2:
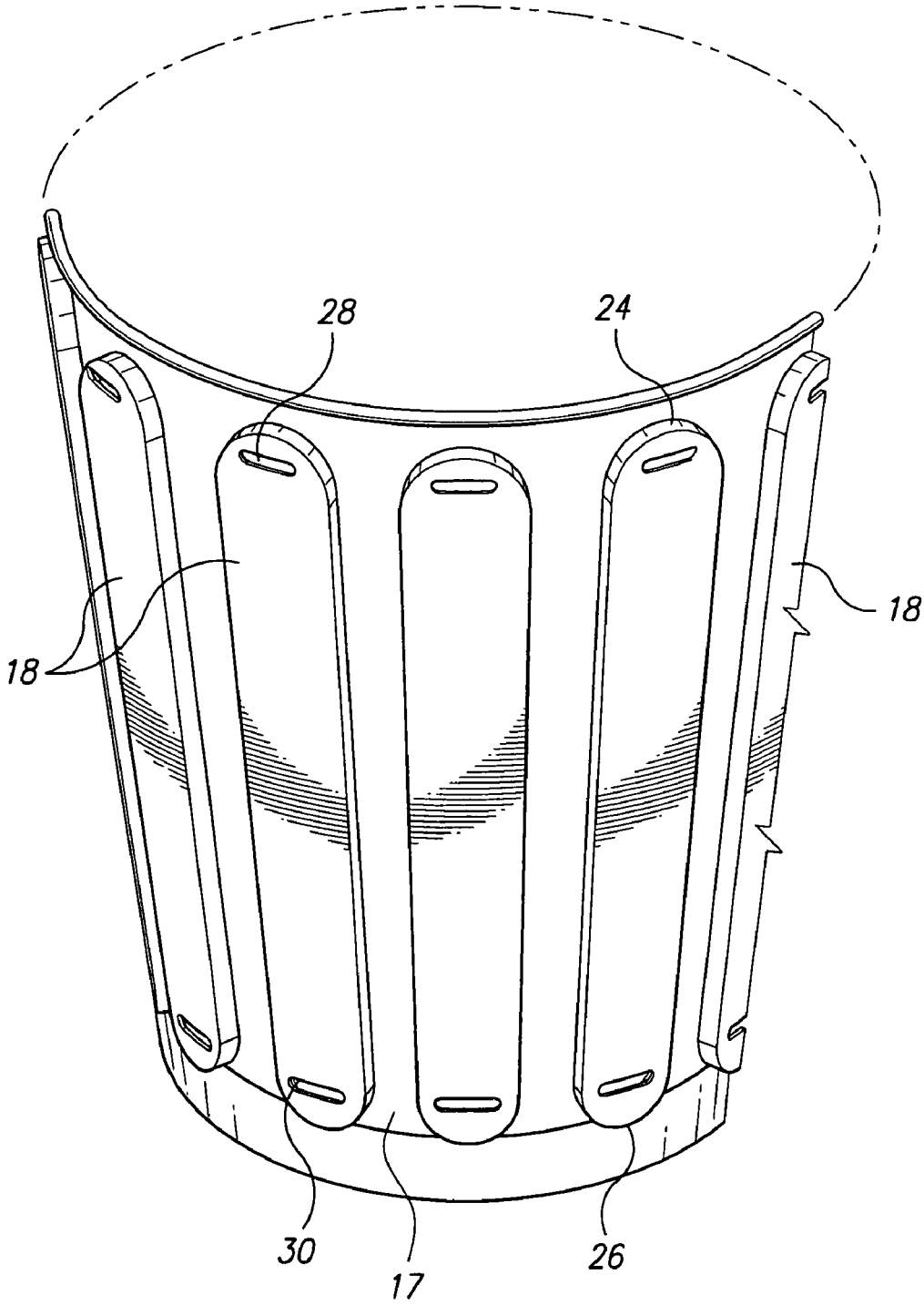
FIG. 2 is a partial perspective view of an alternative embodiment of an insulated beverage container according to the present invention.
Figure 5:
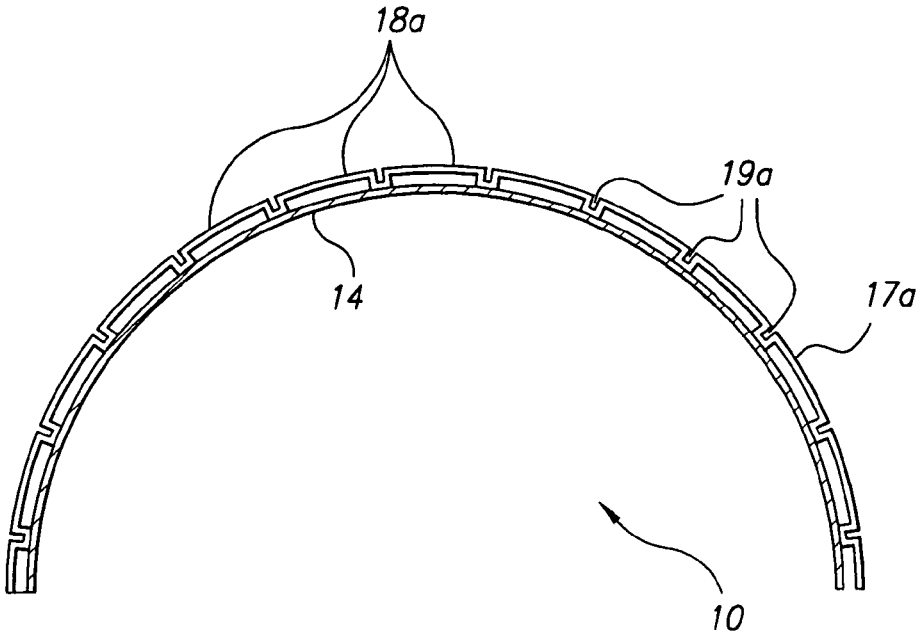
FIG. 5 is a partial top view in section of an alternative embodiment of an insulated beverage container according to the present invention.

As noted above, outer wall 17 is contoured to form tubes 18, and the outer wall 17 is secured to inner wall 14 of container 10. This is best shown in FIGS. 4 and 5. In FIG. 5, an outer wall 17*a* is secured to wall 14, similar to that shown in FIG. 4, with outer wall 17*a* defining tubes 18*a* having a smaller spacing or gap 19*a* than that shown in FIG. 4. In FIG. 1, the upper end of outer wall 17 preferably terminates approximately ⅛ of an inch below rim 22 of the cup, although the degree of spacing may vary in particular embodiments of container 10. In the embodiment of FIG. 2, outer wall 17 is formed to meet the rim 22 without any spacing between the upper edge of outer wall 17 and rim 22.

As shown in FIG. 4, each tube 18 preferably is substantially rectangular in cross-sectional contour, and the tubes 18 are arrayed evenly about the annular wall 14. Tubes 18 are spaced apart by gaps 19, which form additional channels between the tubes 18, thus providing for further thermal insulation. Each tube 18 is elongated along the vertical direction and has upper and lower air flow apertures formed therethrough. In the embodiment of FIG. 1, the upper and lower air flow apertures are formed as open upper and lower ends 21, 23, respectively.

In use, heat generated by the beverage contained within the container 10 heats the air contained within the tubes 18. As the air rises within the tubes 18, ambient air at a lower temperature is drawn through the lower air flow apertures (shown by directional arrows A in FIG. 1) and the heated air is expelled through the upper air flow apertures, as shown by the directional arrows B in FIG. 1. Rather than simply heating and trapping the air contained within tubes 18, the upper and lower air flow apertures allow for efficient heat transfer by continuously replacing the heated air with relatively cooler ambient air.

In the alternative embodiment of FIG. 2, the upper and lower ends 24, 26 of tubes 18 are sealed, via the use of glue or the like, and separate upper and lower air flow apertures 28, 30 are formed through vertically opposed ends of each tube 18. In FIG. 2, the apertures 28, 30 are shown as being substantially oval or elliptical. However it should be understood that apertures 28, 30 may have any desired shape, e.g., rectangular or triangular. Exemplary dimensions and contouring include a 1 mm round hole or a 4 mm round hole. In FIG. 2, the tubes 18 also have rounded contouring on their upper and lower ends 24, 26. It should be understood that the air flow apertures may have any desired size, contour or configuration, dependent upon the desired air flow characteristics and the desired heat transfer rate. Essentially, the larger the area of each aperture, the greater the volume of air that can pass through the tube (and, conversely, the smaller the area, the more restricted heat transfer will be to insulate hot beverages within the cup).

Figure 6:
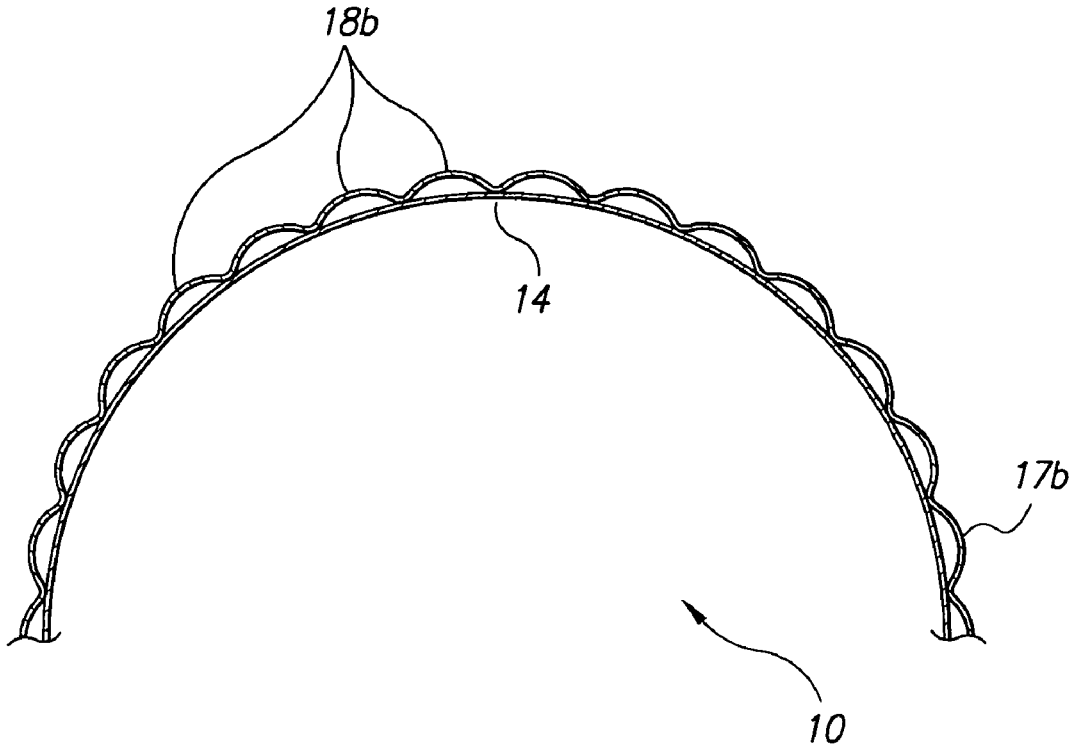
FIG. 6 is a partial top view in section of another alternative embodiment of an insulated beverage container according to the present invention.

In the alternative embodiment of FIG. 5, tubes 18 of the embodiment of FIG. 4 are replaced by tubes 18*a*. Tubes 18*a* are also rectangular, but are closely grouped together, forming a nearly continuous outer surface, with relatively small gaps 19*a* formed therebetween. It should be understood that any suitable number of insulating tubes 18, 18*a*, may be utilized, and the tubes 18, 18*a* may be grouped together in any desired manner. The configurations of FIGS. 4, 5 and 6 are shown for exemplary purposes only. In the alternative embodiment of FIG. 6, outer wall 17*b* forms a plurality of tubes 18*b*, with outer wall 17*b* being a unitary annular corrugated member.

Figure 8:
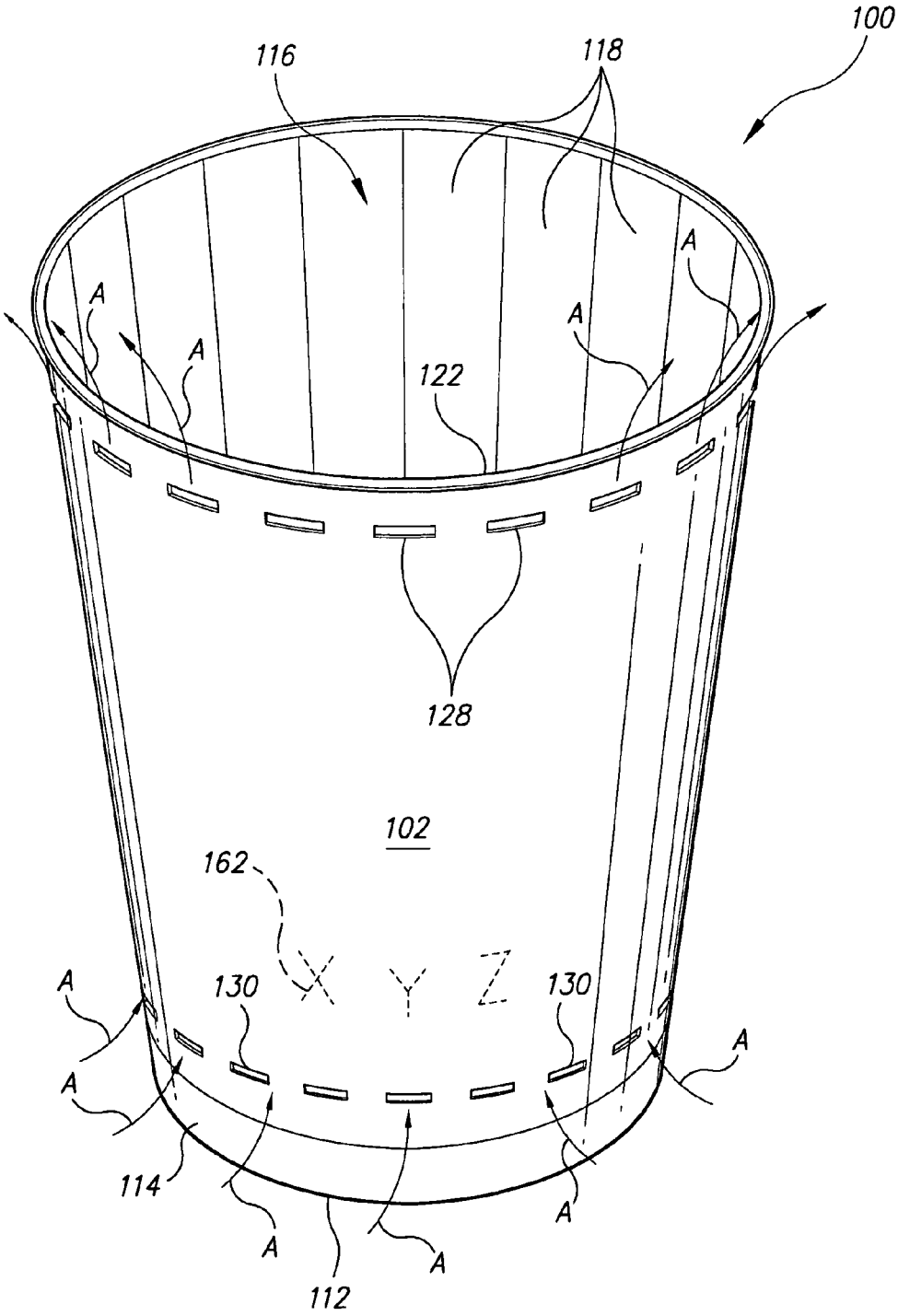
FIG. 8 is a perspective view of another alternative embodiment of the insulated beverage container according to the present invention.
Figure 9:
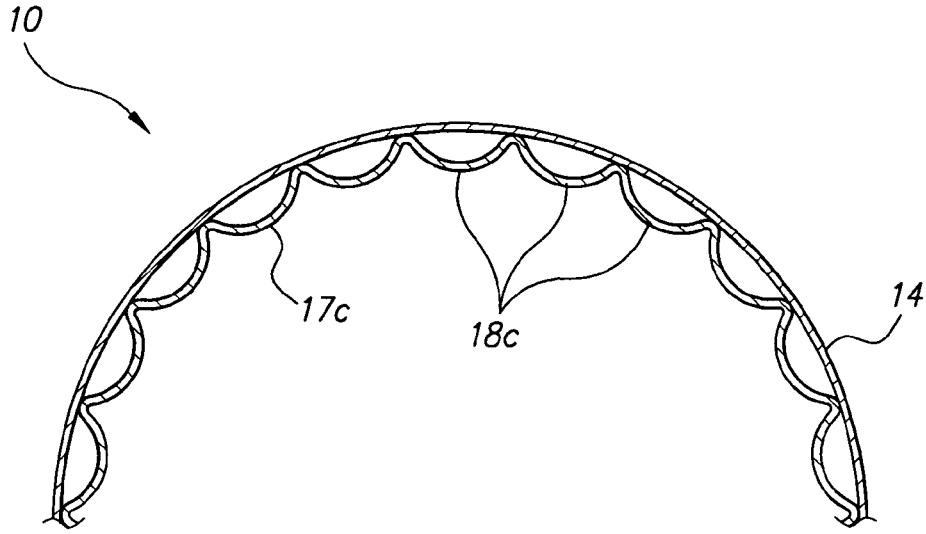
FIG. 9 is a partial top view in section of another alternative embodiment of an insulated beverage container according to the present invention.
Figure 10:
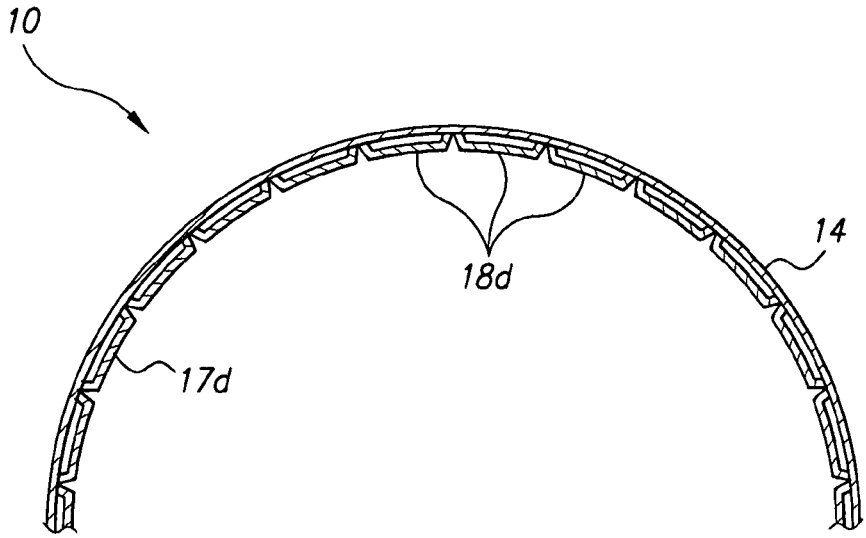
FIG. 10 is a partial top view in section of another alternative embodiment of an insulated beverage container according to the present invention.

Similarly, the configurations of FIGS. 9 and 10 are also shown for exemplary purposes only. In the alternative embodiment of FIG. 9, annular wall 14 is positioned on the exterior side of the beverage container 10, thus providing a smooth and continuous outer surface, with inner wall 17*c* (similar in configuration to wall 17*b* of FIG. 6) forming a plurality of interior tubes 18*c*, with inner wall 17*c* being a unitary annular corrugated member. Similar to FIG. 9, in FIG. 10, annular wall 14 is positioned on the exterior side of the beverage container 10, thus providing a smooth and continuous outer surface, with inner wall 17*d* forming a plurality of interior tubes 18*d*. Tubes 18*d* function in a manner similar to those described above. However, as shown, the tubes 18*d* have a substantially rectangular cross-section, as opposed to the corrugated tubes 18*c*. The embodiments of FIGS. 9 and 10 may be used in combination with the beverage container of FIG. 8, as will be described in detail below.

Figure 7:
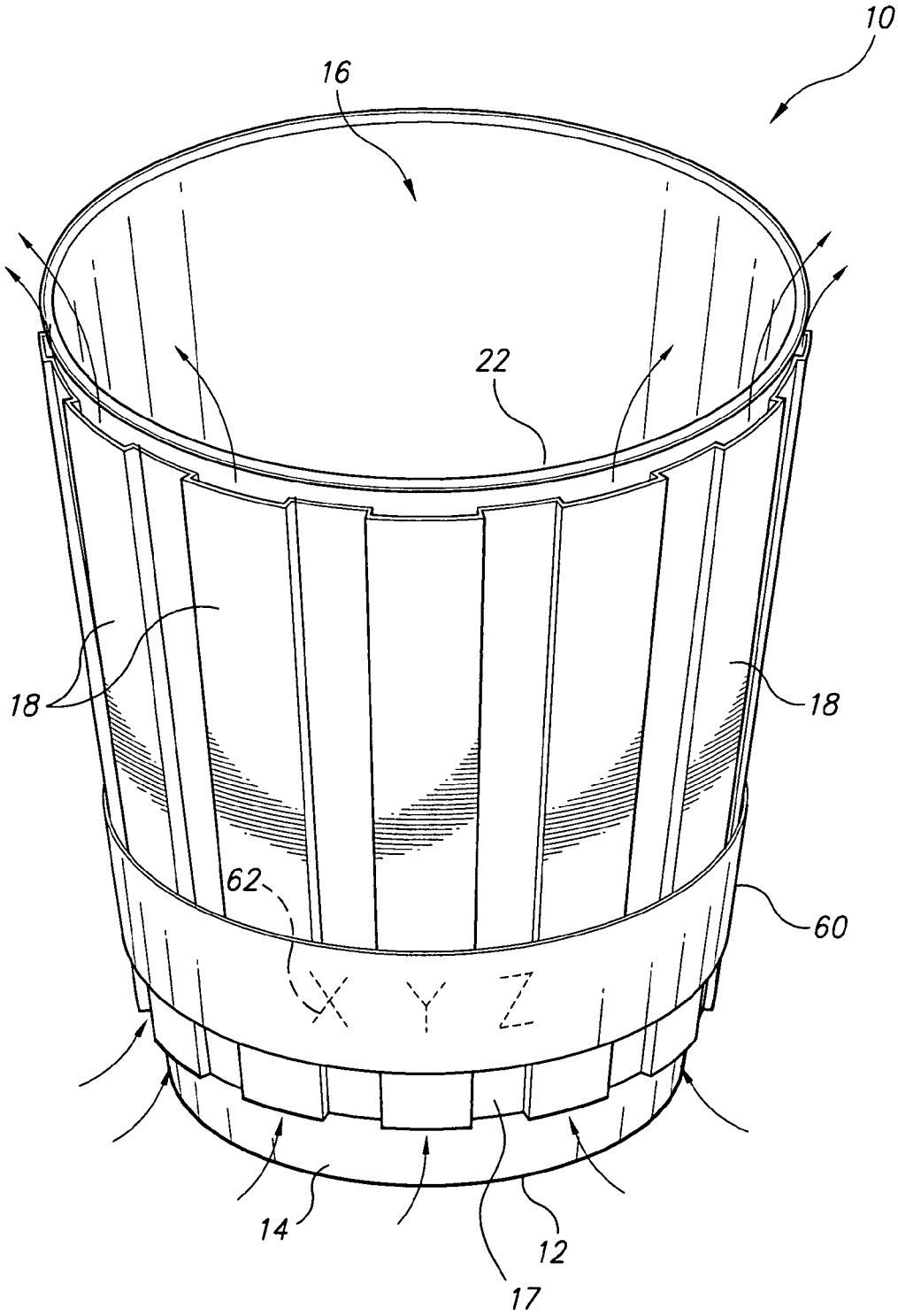
FIG. 7 is a perspective view of another embodiment of an insulated beverage container according to the present invention.

In the embodiment of FIG. 7, a solid, annular band 60 is adhered to, or otherwise mounted on, an outer surface of tubes 18. Solid band 60 may have advertising indicia 62 or other markings formed thereon. Solid band 60 also allows for additional thermal insulation and more effective gripping by the user. It should be understood that solid band 60 is shown for exemplary purposes only, and the band 60 may be positioned on any suitable vertical location of container 10, and also may have any desired dimensions or indicia formed thereon.

FIG. 8 shows another alternative embodiment of the insulated beverage container 100, such as a coffee cup, that provides thermal insulation for the user's hand. Similar to that shown in FIG. 1, the insulated beverage container 100 includes an annular wall 114 having an upper end and a lower end, with the annular wall 114 being elongated along a vertical direction. The upper end may have an annular lip or rim 122 formed thereon that allows for releasable attachment of a lid, as is conventionally known.

A base 112 is secured to the lower end of the annular wall 114 so that an upper surface of the base 112 and the annular wall 114 define an open interior region 116 therein adapted for receiving and containing fluids. The annular wall 114 and base 112 may be formed in any conventional manner to form a beverage receiving cup, as is conventionally known. It should be understood that the container 100 illustrated in FIG. 8 is shown for exemplary purposes only. Preferably, the beverage container 100 is formed from disposable materials, such as cardboard, paper, or a polymeric material, although it should be understood that any suitable material may be used. The beverage container 100 is preferably formed integrally from a polymer-coated paper using any suitable techniques for cutting, sealing and crimping.

As shown, rather than having tubes 18 formed on the outer surface of the cup, as in FIG. 1, a continuous and smooth outer surface 102 is provided, sealed at its upper and lower ends against annular wall 114. A plurality of inner chambers 118, similar to tubes 18 in their function, are defined between the smooth outer surface 102 and the wall 114 (with the divisions between inner chambers 118 being visibly shown within the cup's interior in FIG. 8). This provides smooth and continuous surfaces both in the interior and the exterior of beverage container 100. Similar to the embodiment of FIG. 2, a plurality of upper and lower apertures 128, 130 are provided, with one upper aperture and one lower aperture being associated with each inner chamber or passage. As described in detail above, apertures 128, 130 may have any desired shape and size; e.g., rectangular or triangular, a 1 mm round hole or a 4 mm round hole. As in the embodiments of FIGS. 1 and 2, the air contained within air passages 118 is vented to the atmosphere, so that when a hot beverage is placed within the container 100, the air in the air passages is heated by heat transfer through the inner annular wall 114. At the same time, hot air rises, so that the heated air exits through the upper apertures 128, while cooler air enters from the lower apertures 130 (as indicated by arrows A). Since the equilibrium process and air flow take some time, the air in air passages 118 provides some insulating effect to retard cooling of the beverage relative to an uninsulated cup, but leaves the outside of the container 100 cooler to the touch than comparable insulated cups. Additionally, as in FIG. 7, indicia 162 may be imprinted on outer surface 102 by any desired method.

The above beverage containers are preferably formed so that the containers may be stacked together for ease in transport and storage. It should also be noted that the air held within the tubes is not for purposes of thermal insulation, rather the air flows from the lower, open portion of the tube to the upper portion of the tube as the air is heated, thus maintaining a constant flow of cool air from the environment through the tubes.

It is to be understood that the present invention is not limited to the embodiments described above, but encompasses any and all embodiments within the scope of the following claims.

We claim:

1. An insulated beverage container, comprising:

an annular wall having an upper end and a lower end, wherein the upper end defines a rim, the annular wall being elongated along a vertical direction;

a base attached to the lower end of the annular wall, the base having an upper surface, the upper surface and the annular wall defining a cup adapted for receiving and containing fluids, the cup having an outer surface and an inner surface; and a plurality of tubes attached to one of the surfaces of the cup, each of the tubes being hollow and defining a continuous unobstructed air passage therein, each of the tubes being elongated along the vertical direction and having upper and lower air flow apertures formed therein, wherein each of the tubes has sealed upper and lower ends and an exterior face, the upper and lower apertures being formed through the exterior face of each tube, respectively, adjacent the sealed upper and lower ends thereof, wherein the sealed upper and lower ends are spaced from the rim and base, respectively.

2. The insulated beverage container as recited in claim 1, wherein each of the tubes is substantially rectangular in cross section.

3. The insulated beverage container as recited in claim 1, wherein the plurality of tubes are joined together.

4. The insulated beverage container as recited in claim 3, wherein the plurality of tubes are formed from a unitary, annular, corrugated band.

5. The insulated beverage container as recited in claim 1, further comprising a smooth and continuous annular outer band at least partially covering the exterior face of each said tube.

6. The insulated beverage container as recited in claim 5, wherein the smooth and continuous annular outer band is adapted for having indicia formed thereon.

7. The insulated beverage container as recited in claim 1, wherein the plurality of tubes are attached to the inner surface of the cup.

8. The insulated beverage container as recited in claim 1, wherein the plurality of tubes are attached to the outer surface of the cup.

9. An insulated beverage container, comprising:

an annular wall having an upper end and a lower end, wherein the upper end defines a rim, the annular wall being elongated along a vertical direction;

a base attached to the lower end of the annular wall, the base having an upper surface, the upper surface and the annular wall defining a cup adapted for receiving and containing fluids, the cup having an outer surface and an inner surface; and a plurality of tubes formed on one of the surfaces of the cup, each of the tubes being hollow and defining a continuous unobstructed air passage therein, each of the tubes being elongated along the vertical direction and having upper and lower air flow apertures formed therein, wherein each of the tubes has sealed upper and lower ends and an exterior face, the upper and lower apertures being formed through the exterior face of each tube adjacent the sealed upper and lower ends thereof, respectively, and further wherein the sealed upper and lower ends are spaced from the rim and base, respectively.

* * * * *